United States Patent [19]

Kim et al.

[11] Patent Number: 4,937,631

[45] Date of Patent: Jun. 26, 1990

[54] FUSING UNIT FOR A COPY MACHINE

[75] Inventors: Jae-Hwan Kim; Myoung-Sub Sim, both of Seoul, Rep. of Korea

[73] Assignee: Sindo Ricoh Co., Ltd., Seoul, Rep. of Korea

[21] Appl. No.: 362,229

[22] Filed: Jun. 6, 1989

[51] Int. Cl.[5] ..... G03G 15/20

[52] U.S. Cl. ..... 355/290; 355/309; 355/308; 355/295

[58] Field of Search ..... 355/308, 309, 315, 317, 355/290, 277, 282, 283, 284, 285, 286, 287, 288, 289, 291, 292, 293, 294, 295; 271/250, 251, 274, 272; 226/15, 17

[56] References Cited

U.S. PATENT DOCUMENTS

| | | | |
|---|---|---|---|
| 4,335,951 | 6/1982 | Scribner | 355/295 |
| 4,419,003 | 12/1983 | Fujie et al. | 355/295 |
| 4,572,648 | 2/1986 | Toriumi et al. | 355/290 |
| 4,717,938 | 1/1988 | Tanjo | 355/271 |

*Primary Examiner*—Fred L. Braun
*Assistant Examiner*—Sandra L. Hoffman
*Attorney, Agent, or Firm*—Michael N. Meller

[57] ABSTRACT

An improved heating roller type fusing unit for a copy machine is disclosed in which a guide plate and a guide roller are added to the existing fusing unit consisting of a heating roller and a pressing roller. The guide plate performs the function of conveying the paper to the nip portion, while the guide roller performs the function of applying a lateral tension on the paper before the paper enters into the nip portion, with the result that the nip portion has only to carry out the fusing function.

2 Claims, 2 Drawing Sheets

FUSING UNIT FOR A COPY MACHINE

FIELD OF THE INVENTION

The present invention relates to a fusing unit for a copy machine.

BACKGROUND OF THE INVENTION

Generally, the fusing unit for settling the toner images in a copy machine are used in many cases in the form of a heating roller type fusing unit. This heating roller type fusing unit is known to have high thermal efficiency, and have almost no danger of causing a fire to the paper when jamming. But the problem in this type of fusing unit is that it produces wrinkles on the copied papers. In particular this problem happens frequently in the case of copying the paper on both sides.

In the conventional heating roller type fusing unit as shown in FIG. 1, the wrinkle prevention measure is provided in such manner that the heating roller 1', coated with teflon and the like which can withstand the offset prevention agent, is formed in the shape of an inverse crown. That is, the diameter of the middle portion is slightly smaller than that of the end portions so that wrinkles can be prevented due to the lateral tension caused by the speed difference in conveying the paper. But in such a device, the copied paper produces wavy deformations on its outer edges due to the fact that the opposite side edge portions of the paper receive larger amounts of heat and pressure than the middle portion.

Therefore, if both sides of a paper are copied, the wavy deformations are further increased, forming visible wrinkles. Therefore, the provision of the inverse crown shape gives rather an adverse effect.

Prior attempts to solve this problem, for stretching the paper tightly before the paper enters into the nip portion of the fusing unit, include applying a bias voltage to the guide member, or two heating rollers having different inverse crown are provided in such manner that the moderate inverse crown roller is used for copying a paper on one face, and the steeper inverse crown roller is used for double face copyings. Another attempt includes slightly raising the middle portion of the guide member in such manner that the leading edge of the paper enters into the nip portion simultaneously.

However, all such attempts have not been successful in essentially removing the phenomenon of the wavy deformations and the wrinkles.

SUMMARY OF THE INVENTION

The device including the principles of the present invention is intended to overcome the problems of the wrinkles and the wavy deformations on the copied paper.

Therefore, it is the object of the present invention to provide a heating roller type fusing unit in which the wrinkles on the paper and the wavy deformations on the opposite edge portions of the paper are removed.

In achieving the above object, an embodiment of the present invention provides a guide roller for providing tension in the lateral direction at the front end of the nip portion.

BRIEF DESCRIPTION OF THE DRAWINGS

The above object and other advantages of the present invention will become more apparent by describing the preferred embodiment of the present invention in detail with reference to the attached drawings in which.

DESCRIPTION OF THE PREFERRED EMBODIMENT

In order to overcome the disadvantages of the conventional devices, the present invention provides an improved heating roller type fusing unit by which the wrinkles on the paper and the wavy deformations on the opposite side edges of the paper are substantially removed.

Figure 1:
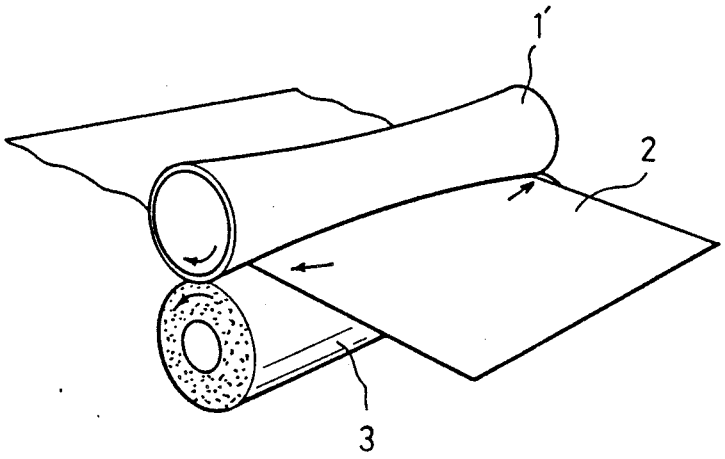
FIG. 1 shows wavy deformations produced in the paper by the conventional heating roller type fusing unit for a copy machine having an inverse crown shape.
Figure 3:
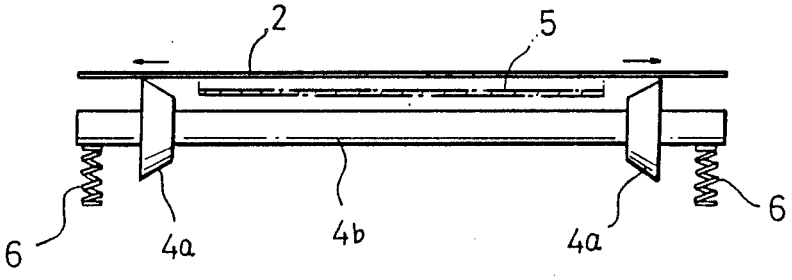
FIG. 3 illustrates a state in which tension is being applied to the paper by the guide rollers of the device according to the present invention.
Figure 2:
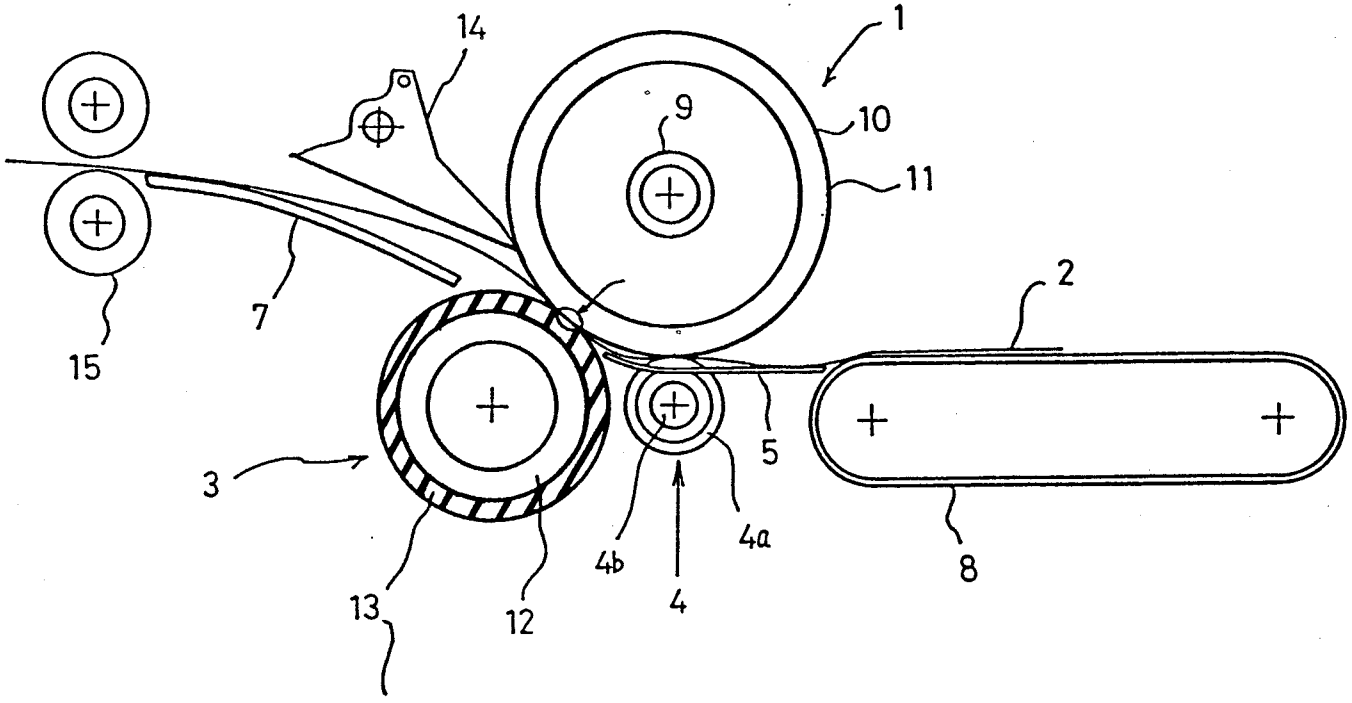
FIG. 2 illustrates the constitution of the fusing unit according to the principles of the present invention.

Now the present invention will be described in detail referring to FIGS. 2 and 3. In a fusing unit in which a paper 2 passes between a heating roller 1 and a pressing roller 3 which contact each other by pressure, a guide roller 4 is provided for applying tension to the paper 2 in the lateral direction. The guide roller 4 makes pressure contact with the heating roller 1, but is separated from the pressing roller 3 by a certain distance. The position of the guide roller 4 is such that the paper 2 contacts the the guide roller 4 before the paper 2 enters into the nip portion of the fusing unit.

In addition, a guide plate 5 is provided for guiding the paper 2 to the nip portion of the fusing unit. As shown in FIG. 3, the guide roller 4 includes a pair of guide rolls 4*a* which are symmetrically disposed and tapered at a certain angle, a support shaft 4*b*, and a pair of springs 6 elastically installed at the opposite ends of the support shaft 4*b*.

In the drawings, numeral 10 indicates a heating roll core, and numeral 12 indicates a pressing roll core. These components will be described in more detail referring to the illustration of FIG. 2. The present invention is constituted such that a guide roller 4 and a guide plate 5 are added to the fusing unit having the heating roller 1 in pressure contact with the pressing roller 3. The surface 11 of the heating roller 1 is coated with a layer of resin having a resistance to an offset prevention agent, such as teflon. A heat source 9 is installed in the interior of roller 1. The pressing roller 3 is clad with a layer of a heat resistant elastic material 13 such as silicon rubber in a certain thickness, and the two rollers 1 and 3 form a nip portion be pressure contact along a certain width.

These two rollers 1 and 3 each having a cylindrical shape with certain outside diameters will produce a uniform pressure along their lengthwise direction.

The guide roller 4 is constituted such that a pair of the guide rolls 4*a* tapered at a certain angle and made of a heat resistant elastic material are concentrically installed on the support shaft 4*b* and symmetrically to the center line of the conveyance of the paper 2. The opposite ends of the suport shaft 4*b* are provided with a pair of springs 6 for pushing the guide rolls 4*a* onto the heating roller 1, the positions of the guide rolls 4*a* being such that both of the rolls 4*a* should come within the size of the smallest regular paper.

For example, assuming that the B5 size paper is the smallest one, the two guide rolls 4*a* should come within a distance of 188 mm. Meanwhile, the guide plate 5 will perform the function of guiding the paper from the rear end of the carrier portion to near the front end of the nip portion of the fusing unit, and therefore, its width has to be at least equivalent to the largest fusable paper size. Further the guide plate 5 is curved starting from the position where the heating roller 1 and the guide roller 4 contact each other, and thus, the curved tip of the guide plate 5 is made to maintain a gap of 1–2 mm from the heating roller 1.

After the nip portion, a separating arcuate member 14, a discharge guide plate 7 and a discharge roller 15 are provided in such manner that they can perform the function of discharging the copied paper to the outside of the fusing unit.

Now the device of the present invention constituted as above will be described as to its operation and effects. First, the paper 2 which has been conveyed along the conveyor belt 8 of the carrier portion has a toner image on it. When the paper comes into the guide roller 4 along the guide plate 5, then the guide roller 4 is deformed and at the same time applies a tension to the paper in the lateral direction thereof as shown in FIG. 3.

Therefore, the paper receives forces in the spreading direction. After undergoing this process, the paper enters into the nip portion, and the fusing of the toner image on the paper is made under a state of pressure, with the result that the wavy deformations produced on the opposite side portions of the paper due to the evaporation of the moisture from the paper upon receipt of a large amount of heat can be prevented.

Thus, unlike the conventional method in which the fusing operation by pressing and heating is carried out at the same time as the applying of the tension to the paper, the present invention divides the operation in such a manner that the nip portion is made to carry out only the fusing function, and the lateral tension is applied to the paper by means of the guide roller. As a result, the wavy deformations which can appear on the opposite side edges of the paper during the passing of the paper through the heating roller type fusing unit are suppressed to the maximum degree, and the wrinkles which can appear on the paper are also prevented.

What is claimed is:

1. A heating roller type fusing unit for a copy machine in which the fusing of the toner image is carried out by passing the toner-applied paper between a heating roller and a pressing roller, said heating and pressing rollers forming a nip therebetween, comprising: a guide roller for applying a lateral tension to the paper before the paper enters into said nip of said fusing unit, means for pressing said guide roller against said heating roller and being separated from said pressing roller; and a guide plate for guiding the paper to said nip.

2. The heating roller type fusing unit as claimed in claim 1, wherein said guide roller comprises: a support shaft and a pair of guide rolls tapered and symmetrically installed on said shaft, and said pressing means comprises a pair of springs respectively installed at opposite ends of said shaft for applying pressure to said shaft.

* * * * *